US010615548B2

(12) United States Patent
Pink et al.

(10) Patent No.: US 10,615,548 B2
(45) Date of Patent: Apr. 7, 2020

(54) SAFETY POWER CONNECTOR

(71) Applicant: Steven Pink, Lutz, FL (US)

(72) Inventors: Steven Pink, Lutz, FL (US); Andrew W. Oravecz, Safety Harbor, FL (US); John Head, III, Largo, FL (US); Richard Paul Spehr, Largo, FL (US); Suzanne Spehr, Largo, FL (US); Jason Mastroprieto, Clearwater, FL (US)

(73) Assignee: Steven Pink, Lutz, FL (US)

( * ) Notice: Subject to any disclaimer, the term of this patent is extended or adjusted under 35 U.S.C. 154(b) by 0 days.

(21) Appl. No.: 16/502,167

(22) Filed: Jul. 3, 2019

(65) Prior Publication Data

US 2020/0014154 A1 Jan. 9, 2020

Related U.S. Application Data

(60) Provisional application No. 62/694,726, filed on Jul. 6, 2018.

(51) Int. Cl.

| | |
|---|---|
| ***H01R 13/703*** | (2006.01) |
| ***H01R 13/447*** | (2006.01) |
| ***H01R 13/648*** | (2006.01) |
| ***H01R 13/62*** | (2006.01) |
| *H01H 27/00* | (2006.01) |
| *H01H 36/00* | (2006.01) |

(52) U.S. Cl.

CPC ..... *H01R 13/7036* (2013.01); *H01R 13/447* (2013.01); *H01R 13/6205* (2013.01); *H01R 13/648* (2013.01); *H01R 13/7037* (2013.01); *H01H 27/00* (2013.01); *H01H 36/00* (2013.01); *H01H 36/0046* (2013.01)

(58) Field of Classification Search

CPC ..... H01R 13/7036; H01R 13/703; H01R 13/7037; H01R 13/6205; H01H 27/00; H01H 36/00; H01H 36/0046

See application file for complete search history.

(56) References Cited

U.S. PATENT DOCUMENTS

| | | | | |
|---|---|---|---|---|
| 6,183,264 | B1 * | 2/2001 | Harsanyi | H01R 13/7037 438/39 |
| 9,190,782 | B2 * | 11/2015 | King | H01R 13/713 |
| 10,069,250 | B2 * | 9/2018 | Niwa | A61B 1/0669 |
| 2007/0149013 | A1 * | 6/2007 | Eastham | H01R 13/7036 439/140 |

(Continued)

*Primary Examiner* — Felix O Figueroa

(74) *Attorney, Agent, or Firm* — Larson & Larson, P.A.; Frank Liebenow; Justin P. Miller

(57) ABSTRACT

A safety power connector includes a male section that has contacts for carrying electric current, one or more magnets, and a protrusion. A female section has a receptacle for receiving the protrusion and contacts that mate with contacts of the male section. When the male section is absent, no "hot" electrical potential is present at the contacts of the female section, thereby reducing potential for an electric shock. When the male section aligns with the female section and the protrusion inserted into the centrally located receptacle of the female section causes closure of a switch in the female section and a magnetic field from the one or more magnets of the male section cause closure of a magnetically actuated switch caused, providing electrical potential to the contacts of the female section that are now in contact with the contacts of the male section.

20 Claims, 13 Drawing Sheets

(56) References Cited

U.S. PATENT DOCUMENTS

| | | | | |
|---|---|---|---|---|
| 2011/0117758 | A1 | 5/2011 | Beak et al. | |
| 2011/0148650 | A1* | 6/2011 | Jenkins ..... | H01R 13/6683 340/686.6 |
| 2012/0171882 | A1 | 7/2012 | Baek et al. | |
| 2013/0337673 | A1 | 12/2013 | King et al. | |
| 2014/0162468 | A1 | 6/2014 | Kim | |
| 2015/0325953 | A1 | 11/2015 | McCracken et al. | |
| 2016/0336695 | A1 | 11/2016 | Janfada et al. | |

* cited by examiner

SAFETY POWER CONNECTOR

CROSS-REFERENCE TO RELATED APPLICATION

This application is a non-provisional application of U.S. patent application Ser. No. 62/694,726, filed Jul. 6, 2018, the disclosure of which is hereby incorporated by reference.

FIELD

This invention relates to the field of electricity and more particularly to a system for improving the safety of providing household electricity.

BACKGROUND

When the human body comes into contact with a source of electricity, some amounts of electric current pass through that body. Depending on the voltage of the electricity, and hence the current passing through the human body, such electrical shock can cause anything from minor discomfort to serious injury, and in some cases, it can cause death.

Young children, particularly toddlers, experience electric shock most often when they bite into electrical cords or poke metal objects such as paper clips or metal toy parts into unprotected outlets.

In recent years, the number of children that were treated for electrical outlet shock is around 2,500. Most of these result in burns, some in neurological issues, but some result in death.

One way to prevent electrical injuries is to cover all outlets, for example, using plastic parts with prongs that fit into the receptacles and attempt to keep children from placing metal objects into the holes of the receptacles. This method is an improvement, but there are many reasons for failure, even when these covers are in use. As outlets are used, parents must remove these plastic covers to insert lamp plugs, etc., sometimes forgetting to replace the plastic covers. Children, especially toddlers, having all the time in the world, often are able to remove plugs, thereby exposing the receptacles. Often, harried parents will remove the plastic cover to use an outlet, then, later, are unable to find the cover and leave the outlet uncovered. The amount of protection any system provides to children is typically inversely proportional to the amount of effort required to maintain such a system.

Another way to prevent electrical injuries is through special outlets that have offset receptacles and a sliding cover plate with holes that match the receptacles. To insert a plug into the outlet, one must place the tips of the plug into the holes, then slide the cover plate in the correct direction so as the holes align with the receptacle, then finish inserting the plug into the receptacle. Again, this is an improvement, but a toddler with time on his/her hands is able to find ways to slide the cover plate and access the receptacles, as easy as opening those "child-proof pill bottles."

Another issue with the existing plug/outlet arrangements is strain relief. There are many ways to secure the plug assembly to the lead wire to keep the lead wire from pulling away from the plug assembly when the lead wire is pulled, either by a user pulling on the lead wire instead of grasping the plug assembly and pulling at the plug assembly or when the lead wire is inadvertently pulled as happens when one trips over the lead wire. The existing plug/outlet arrangement often resists pulling of the plug from the outlet, especially when the lead wire is pulled at an acute angle from the plane in which the outlet is mounted (e.g. the wall). Improper pulling of the lead wire wears the interface between the lead wire and the plug, potentially removing some insulation and exposing conductors which potentially lead to electric shock.

What is needed is a system that will provide improved protection from electrical shock while requiring minimal effort to maintain such protection.

SUMMARY

Power outlets typically have a hot electrical contact, a neutral electrical contact, and often a ground contact. To provide improved safety to an electric outlet, when the outlet is idle, the hot electrical potential is disconnected from the hot electrical contact and, therefore, it is more difficult for a child (or pet) to suffer from electrocution. When a power connector (often referred to as a plug) mates with the outlet, the hot electrical potential is connected to the hot electrical contact by one or more switches for providing electrical power. In some embodiments, a magnet in the power connector (e.g. plug) activates (closes) one of the switches (e.g. a magnetically operated switch or a reed switch or causes a mechanical assembly to move and make contact). In some embodiments, a physical feature of the power connector (e.g. a prong or protrusion) activates one of the switches. In some embodiments, both the magnet and the physical feature are required and both switches are in series, one activated by magnetic field and the other activated by the physical feature. This makes it very difficult for a child to overcome the physical feature and the magnetic feature and, at the same time, touching the hot electrical contact. Note that a simple embodiment of the disclosed invention is a standard electrical outlet that has a switch coupled to the neutral side of the outlet. The switch enables/disables flow of the hot electrical potential to the hot electrical contact such that, when the neutral prong is inserted into the neutral side of the outlet, the switch closes, allowing for flow of the hot electrical potential to the hot electrical contact. In this embodiment, a child would need to insert something into the neutral side of the outlet while also inserting a metal object onto the hot side of the outlet at the same time. This alone would reduce the risk of shock and would work with legacy plugs, only requiring replacement of outlets that need protection from children.

A safety power connector includes a male section (e.g. plug) and a female section (e.g. outlet). The male section has contacts for carrying electric current and one or more magnets arranged in selected polarities. The male section also has a centrally located protrusion (physical feature). The female section has a centrally located receptacle for receiving the protrusion of the male section and contacts that mate with the contacts of the male section. When the male section is absent, no electrical potential is present at the contacts of the female section (e.g. the hot electrical potential is disconnected), thereby reducing potential for an electric shock. When the male section aligns with the female section and the protrusion is inserted into the centrally located receptacle of the female section, closure of a switch in the centrally located receptacle of the female section provides a first step of enabling electrical current to the contacts of the female section. A second, magnetically operated switch (e.g. a reed switch or spring-loaded magnetically operated switch assembly), sensing a magnetic field from the one or more magnets of the male section, closes when the male section is against the female section, thereby providing electrical potential to the contacts of the female section (e.g. providing hot electrical potential to the hot electrical contact) that are in contact with the contacts of the male section. In this, the magnets of the male section attract the female section and hold the male section to the female section. This serves as a strain relief, as the magnets are engineered to release before strain on the lead wire of the male section exceeds any strain relief that is in place for the lead wire.

In some embodiments, the contacts of the female section are ring-shaped allowing for any orientation of the male section with respect to the female section which is an improvement over existing receptacles that only allow for a single orientation. In some such embodiments, the contacts of the male section are also ring-shaped.

In one embodiment, a safety power connector is disclosed including a male section having two or more contacts, a permanent magnet, and a protrusion; and a female section having two or more mating contacts arranged to mate with the two or more contacts of the male section when the protrusion of the male section is within a receptacle of the female section. The female section has a first normally open switch that is closed when the protrusion is within the receptacle and a magnetically operated switch that is closed when the permanent magnet of the male section is in range of the magnetically operated switch. The normally open switch and the magnetically operated switch are arranged in electrical series between a source of electric potential (hot) and one of the two or more contacts. The source of electric potential is disconnected from the one of the two or more contacts until the male section is mated with the female section.

In another embodiment, a safety power connector is disclosed including a male section having two or more contacts, a permanent magnet, and a protrusion; and a female section having two or more mating contacts arranged to mate with the two or more contacts of the male section when the protrusion of the male section is within a receptacle of the female section. The female section has a first normally open switch that is closed when the protrusion is within the receptacle and a magnetically operated switch that is closed when the permanent magnet of the male section is in range of the magnetically operated switch. The normally open switch and the magnetically operated switch are arranged in electrical series between a source of electric potential (hot) and a hot contact of the two or more contacts. Therefore, the source of electric potential is disconnected from the hot contact of the two or more contacts until the male section is mated with the female section.

In another embodiment, a method of improving safety to a power outlet is disclosed including providing a source of power comprising of a hot power and a neutral power and connecting the neutral power to a neutral contact of the safety power outlet. The hot power is then connected to a first side of a first normally open switch and a second side of the first normally open switch is connected to a first side of a second normally open switch and a second side of the second normally open switch is connected to a hot contact of the safety power outlet. This arrangement requires a protrusion from a male connector to close one of the first normally open switch or the second normally open switch and a magnetic field from the male connector to close the other of the first normally open switch or the second normally open switch. Therefore, the hot power is provided to the hot contact of the safety power outlet only after the protrusion from the male connector closes one of the first normally open switch or the second normally open switch and the magnetic field from the male connector closes the other of the first normally open switch or the second normally open switch.

In another embodiment, a safety power connector is disclosed including a male section that has two or more contacts, a permanent magnet, and a protrusion. A female section has two or more mating contacts arranged to mate with the two or more contacts of the male section when the protrusion of the male section is within a receptacle of the female section. The female section has a first normally open switch that is closed when the protrusion is within the receptacle and a magnetically operated switch that is closed when the permanent magnet of the male section is in range of the magnetically operated switch. The normally open switch and the magnetically operated switch are arranged in electrical series between a source of electric potential and one of the two or more contacts so that the source of electric potential is disconnected from the one of the two or more contacts until the male section is mated with the female section.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
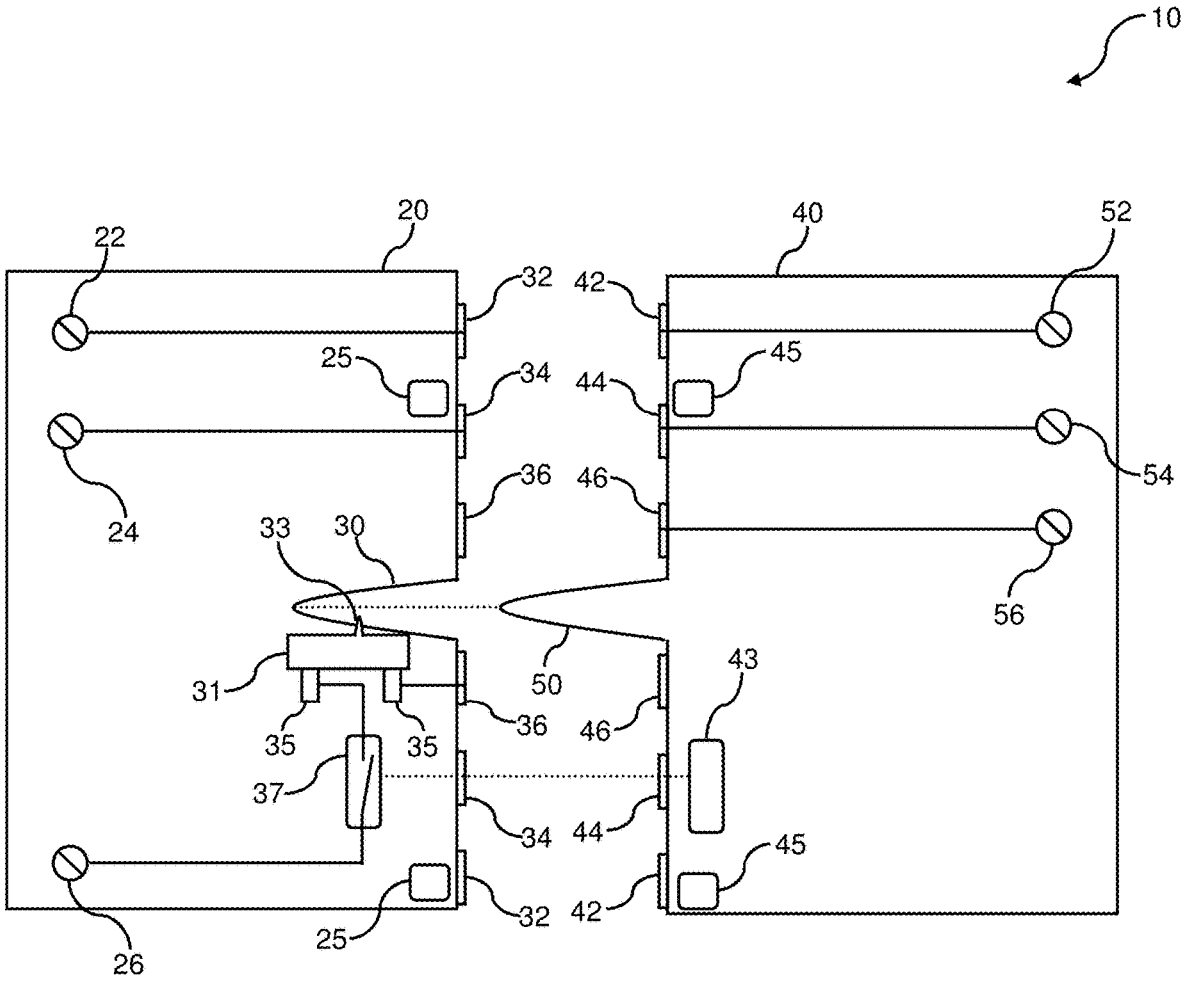
FIG. 1 illustrates a schematic view of a safety power connector.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a schematic view of a safety power connector 10 is shown. The safety power connector 10 has two sections, a female section 20 and a male section 40. The female section 20 is connected to a source of power (not shown) while the male section 40 is typically connected to a sink of power such as a lamp, vacuum cleaner, appliance, etc. The female section 20 is connected to a source of power through two or more connections (three are shown). As shown, a ground connection 22 for connecting to ground potential, a neutral connection 24 for connecting to neutral potential, and a hot connection 26 for connecting to the hot wire in a typical household alternating current arrangement. Note that, as stated, any number of connections are anticipated for any source of power, especially sources of power that have the potential to cause bodily harm, either alternating current or direct current.

The ground connection 22 connects directly to a ground contact 32 and the neutral connection 24 connects directly to a neutral contact 34. Since the ground potential and neutral potential are the safest in typical household alternating current arrangements, the ground contact 32 and neutral contact 34 are closest to the outer edge of the female section 20, making it difficult to reach the hot contact 36, which is located centrally to the female section 20. In some embodiments, the ground contact 32, the neutral contact 34, and the hot contact 36 are concentric, circular conductive planes, enabling contact with the mating ground contact 42, the mating neutral contact 44, and the mating hot contact 46 in any orientation (0-360 degrees).

There are one or two internal switches 31/37 for improving safety of the safety power connector 10. As the contacts 32/34/36 are open and exposed, it would be dangerous to provide electrical potential to the contacts 32/34/36, since the contacts 32/34/36 are easily touched by people, pets, etc. In conventional outlets/plugs, the contacts are recessed within the outlet to reduce contact with people, pets, etc., but a child often finds such recesses interesting for inserting objects such as pens, paperclips, parts of toys, etc., often causing injury. In a preferred embodiment, at least one or two internal switches 31/37 of the safety power connector 10 disconnects the hot contact 36 from the hot connection 26 so that the hot potential of the typical household alternating current arrangement is not present at the hot contact 36 until mating is achieved with a male section 40, thereby reducing the possibility that a child or pet will come into contact with the dangerous potential of the typical household alternating current arrangement.

A first one of the one or two internal switches 31/37 is a manually operated, normally open switch 31, for example, a microswitch or a mechanical assembly that is actuated by mechanical force. This normally open switch 31 has an actuator 33 that is physically interfaced to a receptacle 30 of the female section 20. Therefore, the normally open switch 31 does not complete the circuit between its contacts 35 until the actuator 33 is pushed, and the actuator 33 is pushed when the protrusion 50 of the male section 40 enters the receptacle 30 of the female section 20 at a point where the mating contacts 42/44/46 of the male section 40 are very close or touching the contacts 32/34/36 of the female section 20. Therefore, power is not provided to the hot contact 36 until the male section 40 is abutting the female section 20.

A second one of the one or two internal switches 31/37 is a magnetically actuated switch 37 (e.g. a reed relay or a mechanical assembly that moves by way of magnetic force). In the example shown in FIG. 1, the magnetically actuated switch 37 is connected in series with the normally open switch 31. The magnetically actuated switch 37 closes upon sufficient magnetic field that is supplied by one or more permanent magnets 43 that are mounted within the male section 40 when the male section 40 is in close proximity to the female section 20. As multiple connection orientations between the male section 40 and the female section 20 are anticipated, it is also anticipated that multiple permanent magnets 43 are present in the male section 40.

Therefore, the circuit between the hot connection 26 and the hot contact 36 is not closed (connected) until the normally open switch 31 close closes the circuit between its contacts 35 when the actuator 33 is pushed by the protrusion 50 of the male section 40 and the permanent magnet 43 is close to the magnetically actuated switch 37, causing contacts of the magnetically actuated switch 37 to close. Therefore, power is not provided to the hot contact 36 until the male section 40 is abutting the female section 20.

Safety is improved as, even it an object is pushed into the receptacle 30 far enough to actuate the actuator 33 of the normally open switch 31, it is unlikely that there is sufficient magnetic force near to the magnetically actuated switch 37 to complete the circuit between the hot connection 26 and the hot contact 36. Further, it is unlikely that a child playing with a magnet will find the correct spot to be close to the magnetically actuated switch 37 at the same time that the child is pushing an object into the receptacle 30.

In a preferred embodiment, the receptacle 30 and the protrusion 50 are centrally located.

The mating ground contact 42 of the male section 40 is connected to a ground connection 52 (or directly to the ground conductor of a power cable). The mating neutral contact 44 of the male section 40 is connected to a neutral connection 54 (or directly to the neutral conductor of a power cable). Likewise, the mating hot contact 46 of the male section 40 is connected to a hot connection 56 (or directly to the hot conductor of a power cable).

In some embodiments, additional pairs of magnetic attractors 25/45 are provided to hold the male section 40 to the female section 20 and/or to provide specific orientations. In some embodiments, the magnetic attractors 25 of the female section 20 are magnets and the magnetic attractors 45 of the male section 40 are made of a magnetically attracted material (e.g. steel, iron). In some embodiments, the magnetic attractors 25 of the female section 20 are made of a magnetically attracted material (e.g. steel, iron) and the magnetic attractors 45 of the male section 40 are magnets. In some embodiments, the magnetic attractors 25 of the female section 20 and the magnetic attractors 45 of the male section 40 are magnets. In some such embodiments, pole alignment of the magnets are arranged to provide limitations of rotational orientation.

Figure 1A:
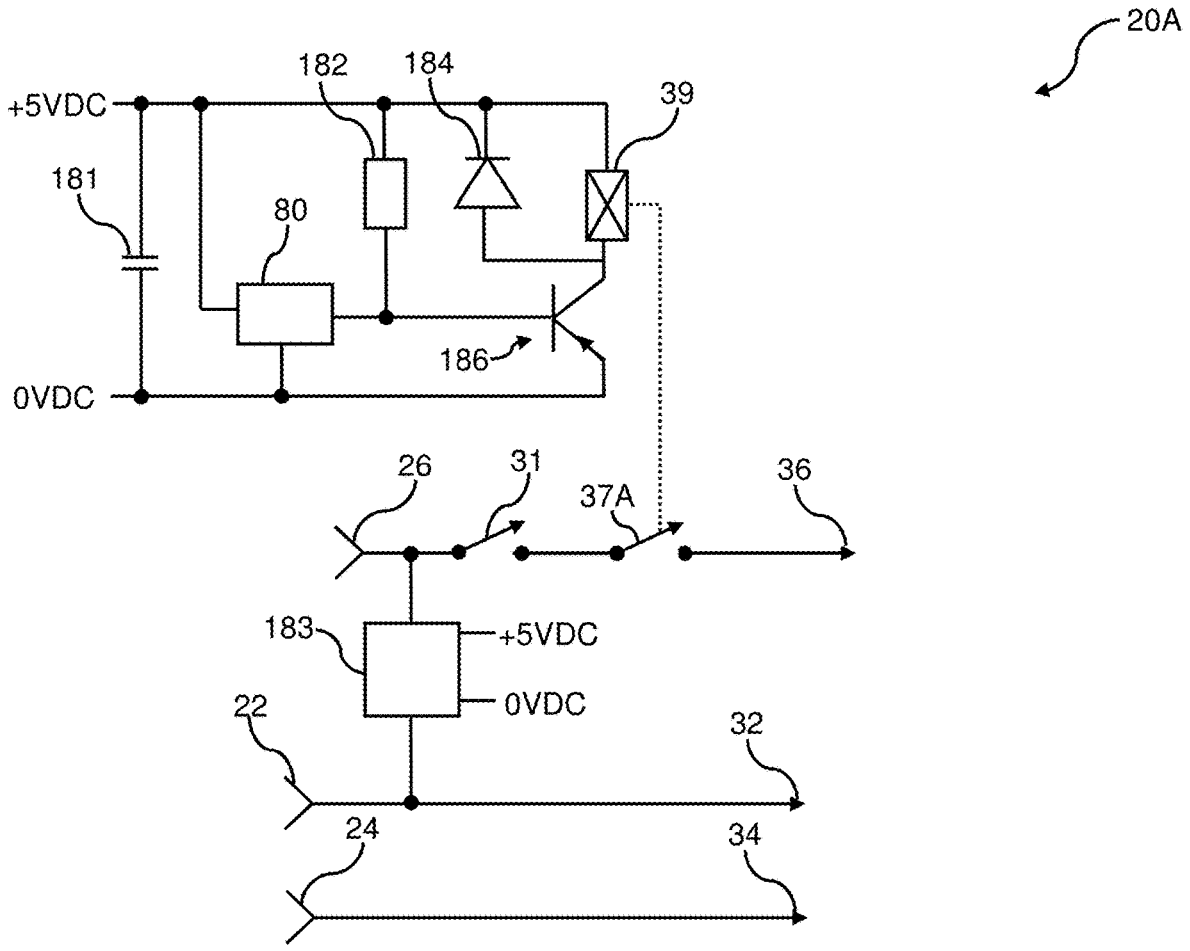
FIG. 1A illustrates an alternate schematic view of a safety power connector.

Referring to FIG. 1A, an alternate schematic view of a safety power connector 10A is shown. The safety power connector 10 has two sections, a female section 20A and a male section 40. The female section 20A is connected to a source of power (not shown) while the male section 40 is typically connected to a sink of power such as a lamp, vacuum cleaner, appliance, etc. The female section 20A is connected to a source of power through two or more connections (three are shown). As shown, a ground connection 22 for connecting to ground potential, a neutral connection 24 for connecting to neutral potential, and a hot connection 26 for connecting to the hot wire in a typical household alternating current arrangement. Note that, as stated, any number of connections are anticipated for any source of power, especially sources of power that have the potential to cause bodily harm, either alternating current or direct current.

The ground connection 22 connects directly to a ground contact 32 and the neutral connection 24 connects directly to a neutral contact 34. Since the ground potential and neutral potential are the safest in typical household alternating current arrangements, the ground contact 32 and neutral contact 34 are preferably closest to the outer edge of the female section 20A, making it difficult to reach the hot contact 36, which is located centrally to the female section 20A. In some embodiments, the ground contact 32, the neutral contact 34, and the hot contact 36 are concentric, circular conductive planes, enabling contact with the mating ground contact 42, the mating neutral contact 44, and the mating hot contact 46 of the male section 40 in any orientation (0-360 degrees).

There are one or two internal switches 31/37A for improving safety of the safety power connector 10. As the contacts 32/34/36 are open and exposed, it would be dangerous to provide electrical potential to the contacts 32/34/36, since the contacts 32/34/36 are easily touched by people, pets, etc. In conventional outlets/plugs, the contacts are recessed within the outlet to reduce contact with people, pets, etc., but a child finds such recesses interesting for inserting objects such as pens, paperclips, parts of toys, etc., often causing injury. The one or two internal switches 31/37A of the safety power connector 10 disconnect the hot contact 36 from the hot connection 26 so that the hot potential of the typical household alternating current arrangement is not present at the hot contact 36 until mating is achieved with a male section 40, thereby reducing the possibility that a child or pet will come into contact with the dangerous potential of the typical household alternating current arrangement.

A first one of the one or two internal switches 31/37 is a manually operated normally open switch 31. This normally open switch 31 has an actuator 33 that is physically interfaced to a receptacle 30 of the female section 20. Therefore, the normally open switch 31 does not complete the circuit between its contacts 35 until the actuator 33 is pushed, and the actuator 33 is pushed when the protrusion 50 of the male section 40 enters the receptacle 30 of the female section 20 at a point where the mating contacts 42/44/46 of the male section 40 are very close or touching the contacts 32/34/36 of the female section 20. Therefore, power is not provided to the hot contact 36 until the male section 40 is abutting the female section 20.

A second one of the one or two internal switches 31/37A is a set of relay contacts 37A. In the example shown in FIG. 1A, a Hall Effect device 80 is magnetically actuated and, when in presence of a magnetic field, the Hall Effect device 80 allows the pull-up resistor 182 to saturate the transistor 186, thereby allowing current to flow through the coil 39 of the relay, closing the relay contact 37A. The relay contacts 37A are in series with the normally open switch 31. The Hall Effect device 80 opens (high impedance) upon sufficient magnetic field that is supplied by one or more permanent magnets 43 that are mounted within the male section 40 when the male section 40 is in close proximity to the female section 20.

Therefore, the circuit between the hot connection 26 and the hot contact 36 is not closed (connected) until the normally open switch 31 closes the circuit between its contacts 35 when the actuator 33 is pushed by the protrusion 50 of the male section 40 and, concurrently, the permanent magnet 43 is close to the Hall Effect device 80, causing the relay contacts 37A to close. Therefore, power is not provided to the hot contact 36 until the male section 40 is abutting the female section 20.

For completeness, a reverse diode 184 is shown to absorb energy from the coil 39 of the relay, as well as a low-voltage power supply 183 and filter capacitor 181.

Safety is improved as, even it an object is pushed into the receptacle 30 far enough to actuate the actuator 33 of the normally open switch 31, it is unlikely that there is sufficient magnetic field near to the magnetically actuated switch 37 to complete the circuit between the hot connection 26 and the hot contact 36. Further, it is unlikely that a child playing with a magnet will find the correct spot to be close to the Hall Effect device 80 at the same time that the child is pushing an object into the receptacle 30.

In a preferred embodiment, the receptacle 30 and the protrusion 50 are centrally located.

The mating ground contact 42 of the male section 40 is connected to a ground connection 52 (or directly to the ground conductor of a power cable). The mating neutral contact 44 of the male section 40 is connected to a neutral connection 54 (or directly to the neutral conductor of a power cable). Likewise, the mating hot contact 46 of the male section 40 is connected to a hot connection 56 (or directly to the hot conductor of a power cable).

In some embodiments, additional pairs of magnetic attractors 25/45 are provided to hold the male section 40 to the female section 20 and/or to provide specific orientations. In some embodiments, the magnetic attractors 25 of the female section 20 are magnets and the magnetic attractors 45 of the male section 40 are made of a magnetically attracted material (e.g. steel, iron). In some embodiments, the magnetic attractors 25 of the female section 20 are made of a magnetically attracted material (e.g. steel, iron) and the magnetic attractors 45 of the male section 40 are magnets. In some embodiments, the magnetic attractors 25 of the female section 20 and the magnetic attractors 45 of the male section 40 are magnets. In some such embodiments, pole alignments of the magnets are arranged to provide limitations of rotational orientation.

Figure 1B:
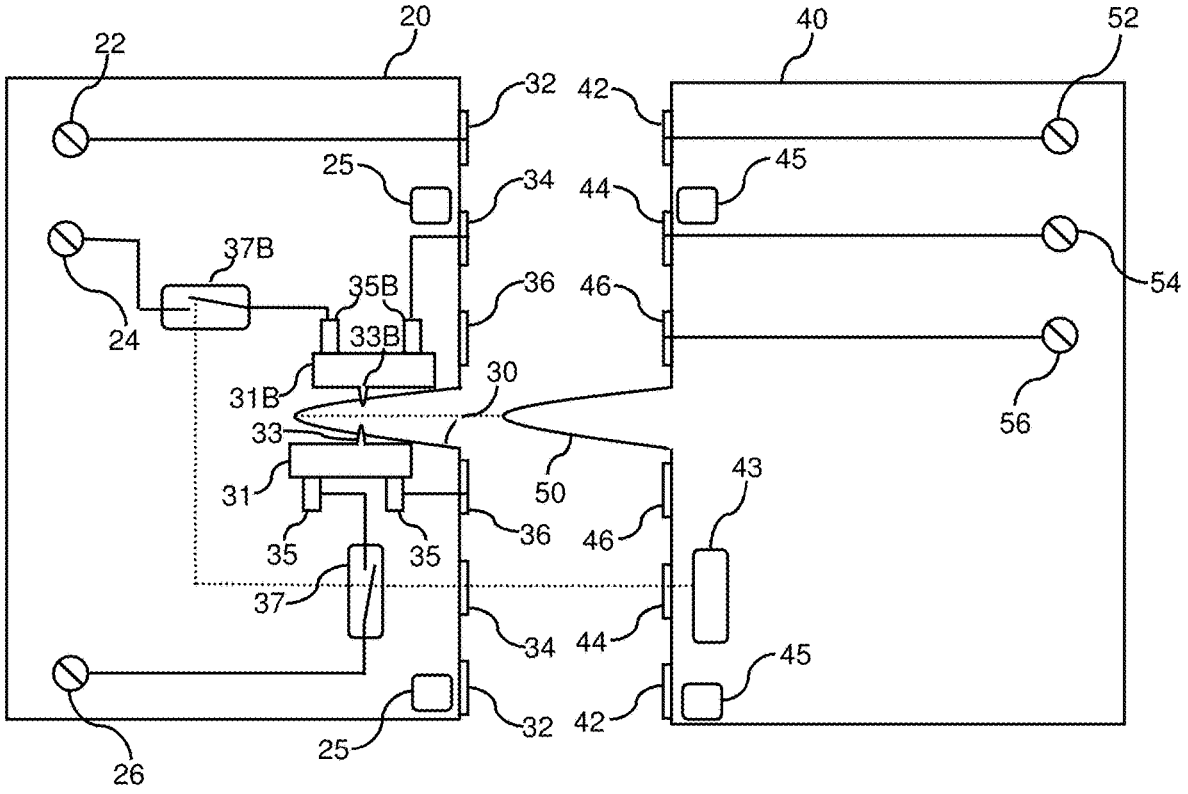
FIG. 1B illustrates an alternate schematic view of a safety power connector.
Figure 1C:
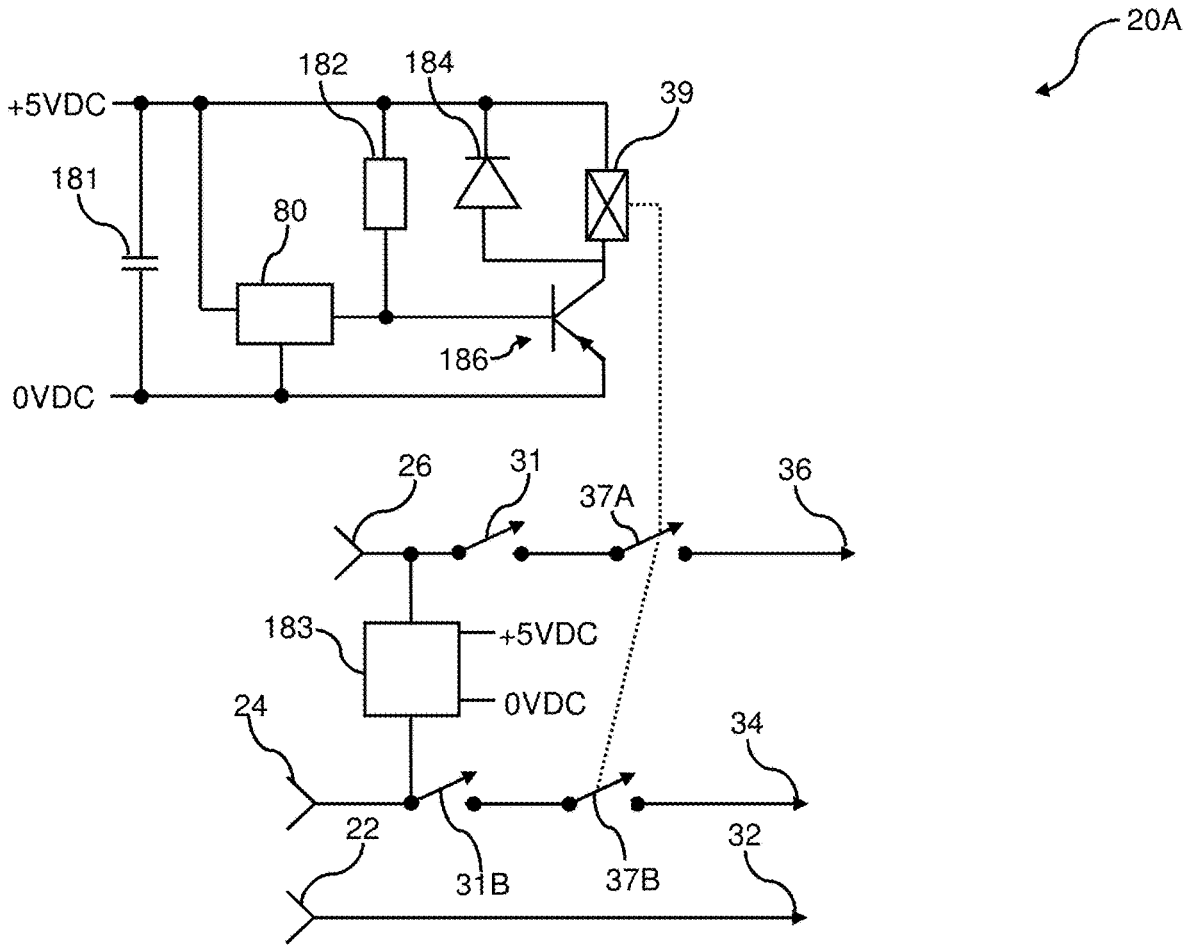
FIG. 1C illustrates an alternate schematic view of a safety power connector.

Referring to FIGS. 1B and 1C, alternate embodiments are shown in which both the hot circuit and the neutral circuit are disabled until the male section 40 is mated with the female section 20/20A. In the example of FIG. 1B, a second normally open switch 31B having an actuator 33B and contacts 35B operates similar to the normally open switch 31 and is coupled to a second magnetically operated switch 37B that operates similar to the magnetically operated switch 37. The second normally open switch 31B and the second magnetically operated switch 37B are electrically inserted in series between the neutral connection 24 and the neutral contact 34. Therefore, in absence of the male section 40, the neutral connection 24 is isolated from the neutral contact 34. This provides added safety should an electrician/installer wrongly wire the female section 20 (e.g. intermixing the hot and neutral wires). Note that although shown as separate switches, it is also anticipated that the normally open switch 31 and the second normally open switch 31B be a single, single-throw, double-pole normally open switch. Likewise, it is also anticipated that the magnetic switch 37 and second magnetic switch 37B be combined into a single-throw, double-pole, normally open magnetic switch.

In the example of FIG. 1C, a second normally open switch 31B having an actuator 33B and contacts 35B operates similar to the normally open switch 31 This normally open switch 31 has an actuator 33B that is physically interfaced to a receptacle 30 of the female section 20. Therefore, the second normally open switch 31B does not complete the circuit between its contacts 35B until the actuator 33B is pushed, and the actuator 33B is pushed when the protrusion 50 of the male section 40 enters the receptacle 30 of the female section 20. As with FIG. 1B, it is anticipated that the normally open switch 31 and the second normally open switch 31B be a single, single-throw, double-pole normally open switch.

The second normally open switch 31B is coupled to a second magnetically operated switch 37B that operates similar to the magnetically operated switch 37. The second normally open switch 31B and the second magnetically operated switch 37B are electrically inserted in series between the neutral connection 24 and the neutral contact 34. Therefore, in absence of the male section 40, the neutral connection 24 is isolated from the neutral contact 34. This provides added safety should an electrician/installer wrongly wire the female section 20 (e.g. intermixing the hot and neutral wires). Note that although shown as separate switches, it is also anticipated that the normally open switch 31 and the second normally open switch 31B be a single, single-throw, double-pole normally open switch. Likewise, it is also anticipated that the magnetic switch 37 and second magnetic switch 37B be combined into a single-throw, double-pole, normally open magnetic switch.

In FIG. 1C, the Hall Effect device 80 is magnetically actuated and, when in presence of a magnetic field, the Hall Effect device 80 allows the pull-up resistor 182 to saturate the transistor 186, thereby allowing current to flow through the coil 39 of the relay, closing the relay contacts 37A/37B. The relay contacts 37A/37B are in series with the normally open switches 31/31B. The Hall Effect device 80 opens (high impedance) upon sufficient magnetic field that is supplied by one or more permanent magnets 43 that are mounted within the male section 40 when the male section 40 is in close proximity to the female section 20.

Therefore, in this example, the normally open switch 31 and the second normally open switch 31B closes the circuit between its contacts 35/35B when the actuator 33 is pushed by the protrusion 50 of the male section 40 and, concurrently, the permanent magnet 43 is close to the Hall Effect device 80, causing the relay contacts 37A/37B to close. Therefore, the circuit between the hot connection 26 and the hot contact 36 is not closed (connected) and the circuit between the neutral connection 24 and the neutral contact 34 is not closed (connected) until the male section 40 is abutting the female section 20.

For completeness, a reverse diode 184 is shown to absorb energy from the coil 39 of the relay, as well as a low-voltage power supply 183 and filter capacitor 181.

In this embodiment, safety is further improved by disconnecting both the hot electrical potential and the neutral electrical potential from the contacts 34/36 until the male section 40 is in contact with the female section 20, as an electrician or installer might reverse the connections to the hot connection 26 and the neutral connection 24.

Figure 2:
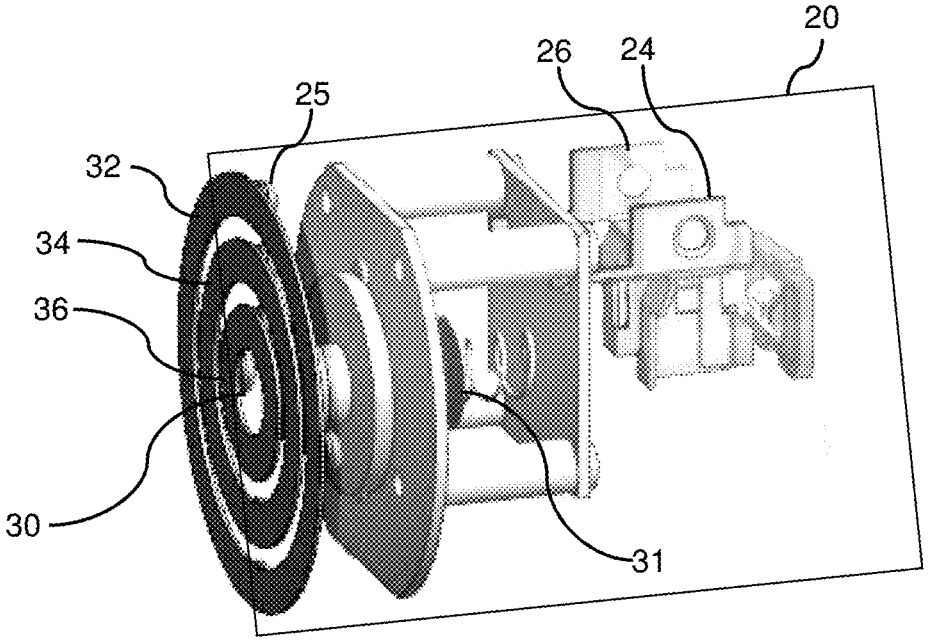
FIGS. 2 and 3 illustrates perspective views a female section of the safety power connector.
Figure 3:
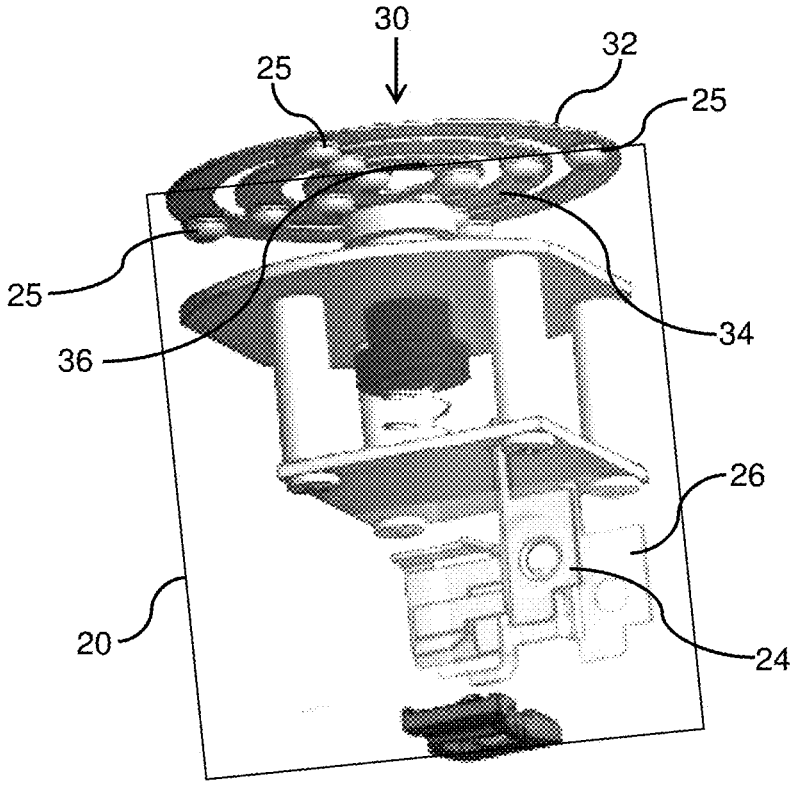

Referring to FIGS. 2 and 3, perspective views a female section 20 of the safety power connector 10 are shown. In this view, the ground contact 32, neutral contact 34, and the hot contact 36 are fabricated as concentric, circular planes, the hot contact 36 being the most central of the concentric, planar rings. The ground contact 32 and neutral contact 34 are closest to the outer edge of the female section 20, making it difficult to reach the hot contact 36 when the male section 40 mates with the female section 20. Note that any form and/or shape of contacts 32/34/36 are anticipated and concentric, circular planes (as shown) are preferred, providing for many rotational orientations of the male section 40 with respect to the female section 20.

Note that in some embodiments, instead of using a reed switch for the magnetically actuated switch 37, different spring-loaded mechanisms are anticipated in which, when the male section 40 approaches the female section 20, the permanent magnets 43 of the male section 40 deform the spring-loaded mechanisms, making internal contact to provide the hot potential to the hot contact 36.

Also visible are magnetic attractors 25 for magnetic positioning and holding between the male section 40 and the female section 20, though in some embodiments, instead of magnetic attractors 25/45, there is a mechanical mechanism in the receptacle 30 for temporarily capturing the protrusion 50 of the male section 40.

The receptacle 30 and manually operated normally open switch 31 are visible, as is only two of the connections, the neutral contact 34 and the hot contact 36.

Figure 4:
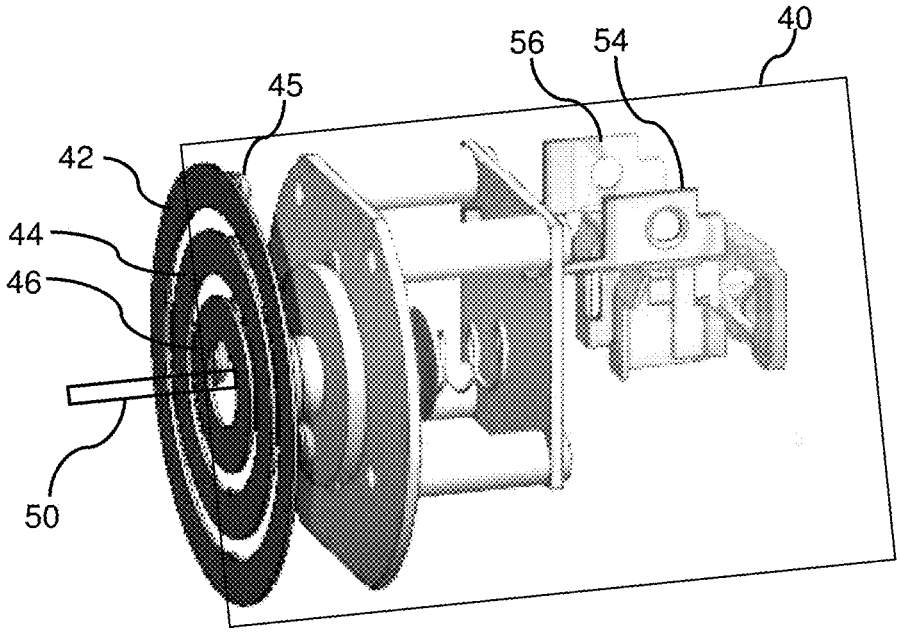
FIG. 4 illustrates perspective views a male section of the safety power connector.

Referring to FIG. 4, a perspective view of a male section 40 of the safety power connector 10 is shown. The mating ground contact 42 of the male section 40 is connected to a ground connection 52 (not shown). The mating neutral contact 44 of the male section 40 is connected to a neutral connection 54 (or directly to the neutral conductor of a power cable). Likewise, the mating hot contact 46 of the male section 40 is connected to a hot connection 56 (or directly to the hot conductor of a power cable). The protrusion 50 is shown emanating from a central location, though there is no specific location required, only that the protrusion 50 mate up with the receptacle 30 when the male section 40 mates with the female section 20.

Figure 5:
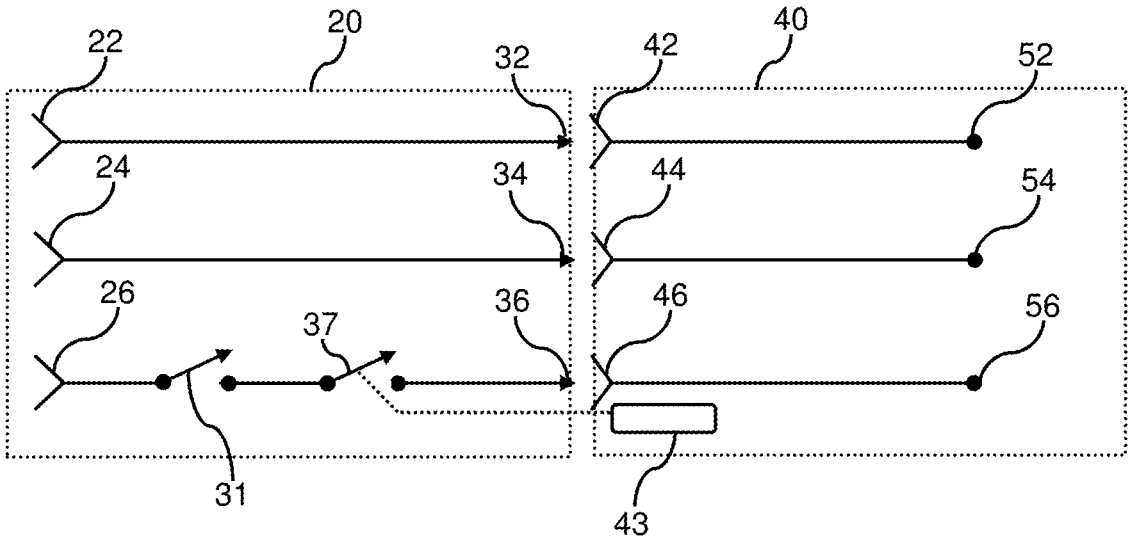
FIGS. 5 and 5A illustrate schematic diagrams of the safety power connector.
Figure 5A:
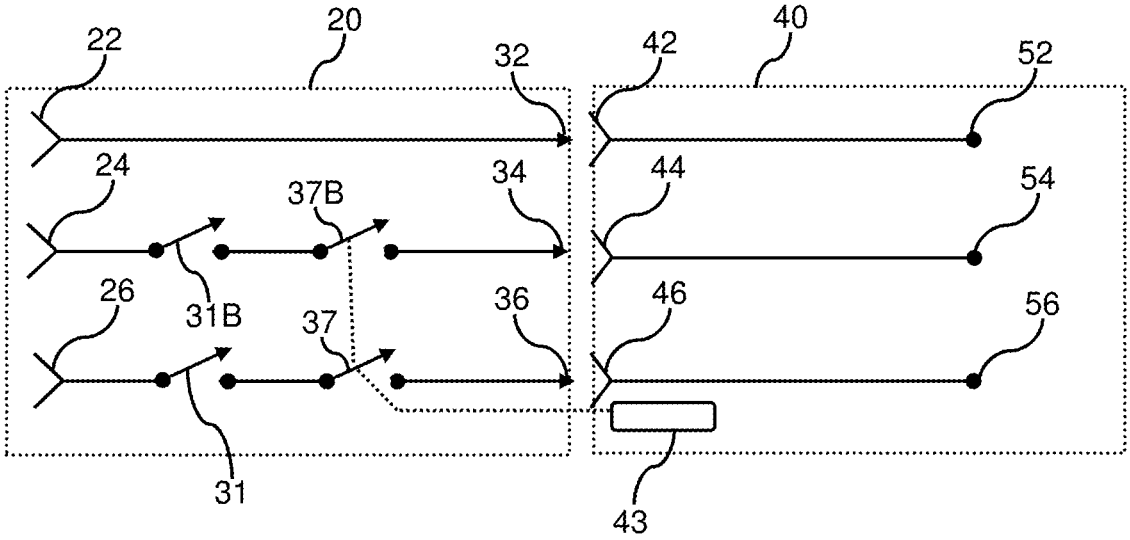

Referring to FIGS. 5 and 5A, schematic diagrams of the safety power connector 10 are shown. The safety power connector 10 has two sections, a female section 20 and a male section 40. The female section 20 is connected to a source of power (not shown) while the male section 40 is typically connected to a sink of power. The female section 20 is connected to a source of power through two or more connections (three are shown). As shown, a ground connection 22 for connecting to ground potential, a neutral connection 24 for connecting to neutral potential, and a hot connection 26 for connecting to the hot wire in a typical household alternating current arrangement. Note that, any number of connections are anticipated for any source of power, especially sources of power that have the potential to cause bodily harm, either alternating current or direct current.

The ground connection 22 connects directly to a ground contact 32 and the neutral connection 24 connects directly to a neutral contact 34, although in some embodiments the two switches 31/37 have a second set of contacts that are electrically inserted in series between the neutral connection 24 and the neutral contact 34 for added safety should the outlet be wired wrong by an installer. Shown are two switches 31/37 for improving safety of the safety power connector 10. The switches 31/37 are configured in series between the hot contact 36 and the hot connection 26. The switches 31/37 are shown open and, therefore, the hot potential of the typical household alternating current arrangement is not connected to the hot contact 36, thereby reducing the possibility that a child or pet will come into contact with the dangerous potential of the typical household alternating current arrangement. Upon activation and closure of the normally open switch 31 and magnetic activation, and therefore closure, of the magnetically actuated switch 37, the hot contact 36 is electrically connected to the hot connection 26, thereby providing electrical potential to the hot contact 36.

The mating ground contact 42 of the male section 40 is connected to a ground connection 52 (or directly to the ground conductor of a power cable). The mating neutral contact 44 of the male section 40 is connected to a neutral connection 54 (or directly to the neutral conductor of a power cable). Likewise, the mating hot contact 46 of the male section 40 is connected to a hot connection 56 (or directly to the hot conductor of a power cable).

In FIG. 5A, The ground connection 22 connects directly to the ground contact 32 but the neutral connection 24 connects to the neutral contact 34 through a second set of contacts that are electrically inserted in series between the neutral connection 24 and the neutral contact 34 for added safety should the outlet be wired wrong by an installer. Shown are four switches 31/31B/37/37B for improving safety of the safety power connector 10. The switches 31/37 are configured in series between the hot contact 36 and the hot connection 26. The switches 31/37 are shown open and, therefore, the hot potential of the typical household alternating current arrangement is not connected to the hot contact 36, thereby reducing the possibility that a child or pet will come into contact with the dangerous potential of the typical household alternating current arrangement. Upon activation and closure of the normally open switch 31 and magnetic activation, and therefore closure, of the magnetically actuated switch 37, the hot contact 36 is electrically connected to the hot connection 26, thereby providing electrical potential to the hot contact 36.

The switches 31B/37B are configured in series between the neutral contact 34 and the neutral connection 24. The switches 31B/37B are shown open and, therefore, the neutral potential of the typical household alternating current arrangement is not connected to the neutral contact 34, thereby reducing the possibility that a child or pet will come into contact with a dangerous electrical potential should the outlet be wired wrong. Upon activation and closure of the second normally open switch 31B and magnetic activation, and therefore closure, of the second magnetically actuated switch 37B, the neutral contact 34 is electrically connected to the neutral connection 24, thereby providing electrical potential to the neutral contact 34.

Figure 6:
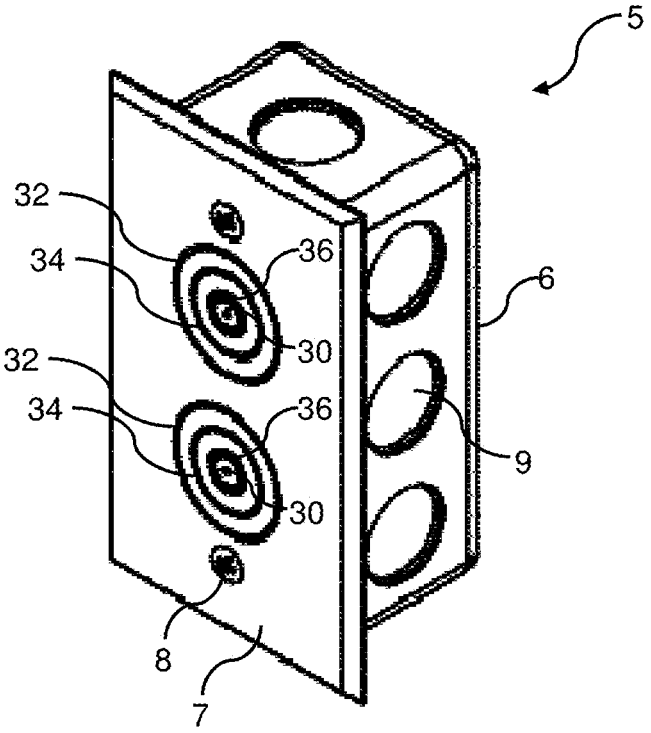
FIG. 6 illustrates a perspective view of two of the female sections of the safety power connector.

Referring to FIG. 6, a perspective view of two of the female sections 20 of the safety power connector 10 are shown in a standard electrical box 6. It is anticipated that the standard electrical box 6 is mounted in a wall of a building and power is connected through one or more knockouts 9 (or any other power feed-through as known in the industry). In this, there are two female sections 20, the contacts 32/34/36 of each extend out of the faceplate 7. The faceplate is held to the standard electrical box 6 by two screws 8.

Figure 7:
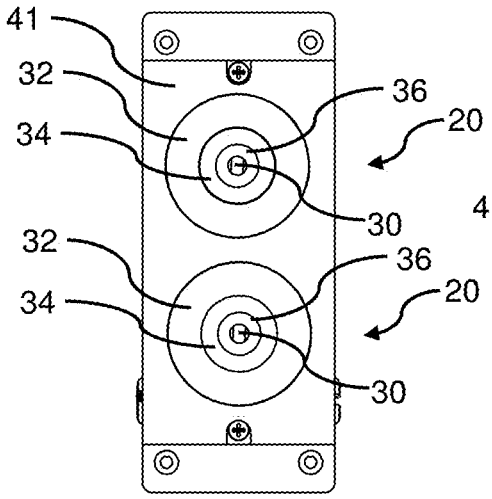
FIG. 7 illustrates a plan view of two of the female sections of the safety power connector.

Referring to FIG. 7, a plan view of two of the female sections of the safety power connector 10. In this, the two female sections of the safety power connector are mounted to a plate 41 that shields internal components. It is anticipated that the female sections of the safety power connector 10 mount within a standard electrical box 6 that is mounted in a wall of a building and power is connected through, for example, one or more knockouts 9 (see FIG. 6). In this, there are two female sections 20, the contacts 32/34/36 of each female section 20 are supported by the plate 41.

Figure 8:
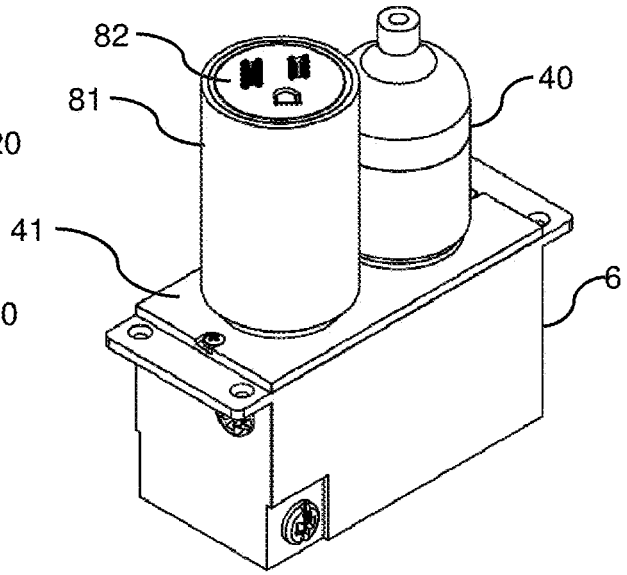
FIG. 8 illustrates a perspective view of the two female sections of the safety power connector, one having a male section of the safety power connector and the other having a male section to standard outlet converter.

FIG. 8 illustrates a perspective view of the two female sections 20 (occluded in FIG. 8) of the safety power connector 10, one having a male section 40 of the safety power connector 10 and the other having a male section to standard outlet converter 81. It is anticipated that the male section 40 of the safety power connector 10 be connected by wire to an appliance, lamp, or any other electrical device. The male section to standard outlet converter 81 is an example of a outlet converter 81 the connects legacy electrical devices (e.g. having two or three prong plugs as known in the industry) to the female sections 20 of the safety power connector 10. As shown, the male section to standard outlet converter 81 has a standard three-prong receptacle 82 for connecting legacy electrical devices, though any type of receptacle is anticipated.

Figure 9:
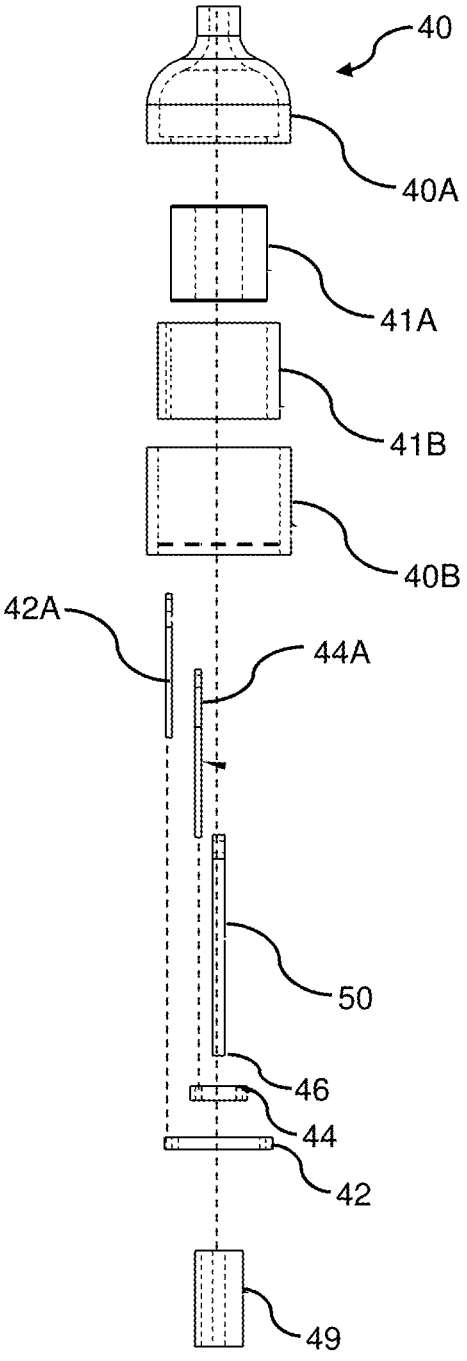
FIG. 9 illustrates an exploded view of the male section of the safety power connector.
Figure 10:
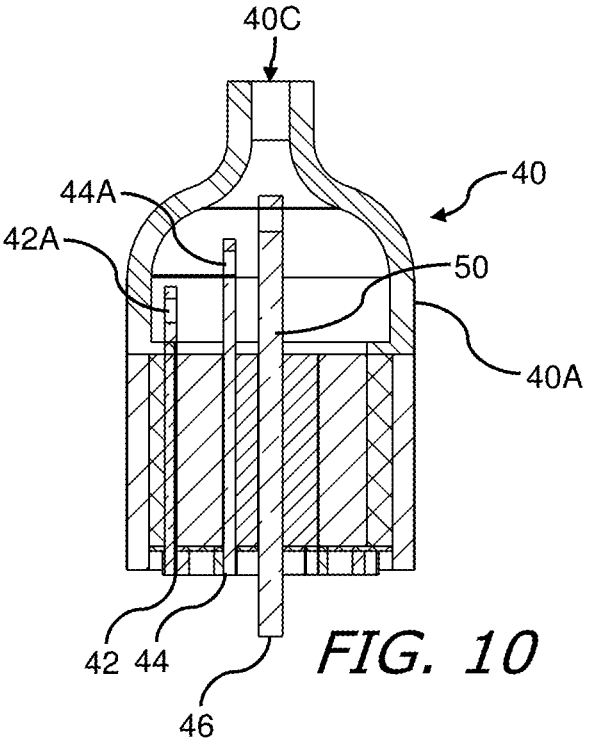
FIG. 10 illustrates a cut-away view of the male section of the safety power connector.
Figure 11:
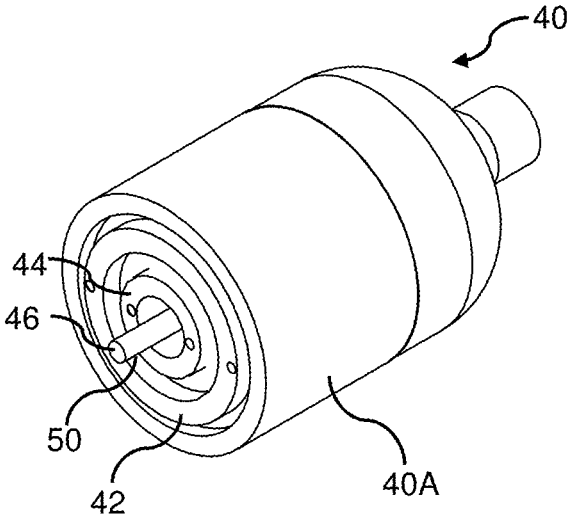
FIG. 11 illustrates a perspective view of the male section of the safety power connector.
Figure 12:
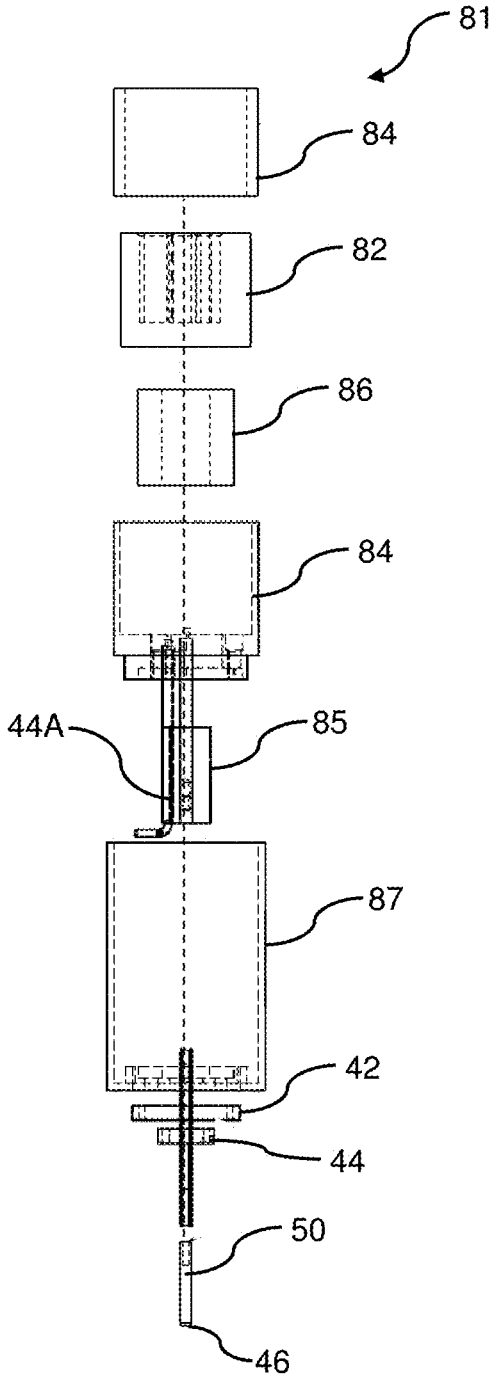
FIG. 12 illustrates an exploded view of the male section to standard outlet converter.
Figure 13:
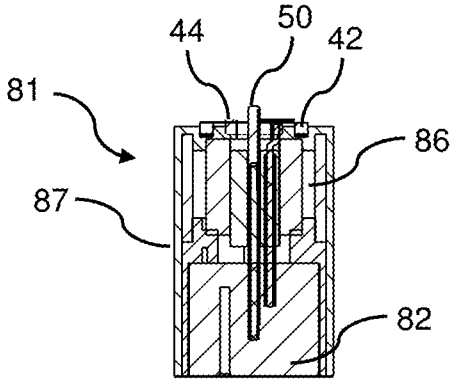
FIG. 13 illustrates a cut-away view of the male section to standard outlet converter.
Figure 14:
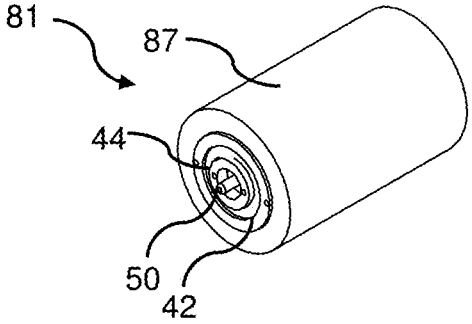
FIG. 14 illustrates a front-perspective view of the male section to standard outlet converter.
Figure 15:
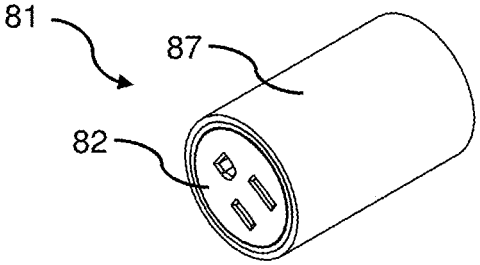
FIG. 15 illustrates a rear-perspective view of the male section to standard outlet converter.

Referring to FIGS. 9, 10, and 11, views of an exemplary embodiment of the male section 40 of the safety power connector 10. The mating ground contact 42 of the male section 40 is connected to a ground interconnect 42A that connects to a ground wire (not shown e.g., by soldering or a screw terminal). The mating neutral contact 44 of the male section 40 is connected to a neutral interconnect 44A that connects to a neutral wire (not shown e.g., by soldering or a screw terminal). The protrusion 50 is shown emanating from a central location and also serves as the mating hot contact 46 of the male section 40 and connects to a hot wire (not shown e.g., by soldering or a screw terminal). Note that there is no specific location required for the protrusion 50, only that the protrusion 50 mate up with the receptacle 30 when the male section 40 mates with the female section 20.

In the example shown, the male section 40 of the safety power connector 10 has a cap portion 40A having an opening 40C for accepting a power cable (not shown) that is often tied in a knot within the cap portion 40A for strain relief and attached to the ground interconnect 42A, the neutral interconnect 44A, and to the protrusion 50/mating hot contact 46.

In this example, there are two magnets 41A/41B for sufficient magnetic strength. Around the two magnets 41A/41B is a magnetic shield 40B that encapsulates the magnetic field of the two magnets 41A/41B so that the magnetic field does not falsely enable an adjacent female sections 20 of the safety power connector 10. The hot guide 49 maintains the position of the protrusion 50 and insulates the protrusion 50 from the mating neutral contact 44.

Referring to FIGS. 12, 13, 14, and 15, views of an exemplary male section to standard outlet converter 81 are shown. At the top of the male section to standard outlet converter 81 is a standard three-prong receptacle 82, though any known receptacle is anticipated. A metal shield 84 encloses the standard three-prong receptacle 82. In this example, a single magnet 86 is included (for closing the magnetic switch of the female section 20). The mating ground contact 42 of the male section 40 is connected to the standard three-prong receptacle 82 through the metal shield 84. The mating neutral contact 44 of the male section 40 is connected to a neutral interconnect 44A that connects to a neutral wire of the standard three-prong receptacle 82. The protrusion 50 is shown emanating from a central location and also serves as the mating hot contact 46 of the male section 40 and connects to the hot terminal of the standard three-prong receptacle 82. An insulator 85 maintains electrical separation of the neutral interconnect 44A and protrusion 50. A cover 87 insulates and provides protection to the male section to standard outlet converter 81.

Although several examples of specific implementations of the safety power connector 10 are shown, these are examples and are not meant to limit the breadth of the present application in any way. There are many ways anticipated to energize a magnetically operated switch of the female section of the safety power connector 10 by way of a magnetic field emanating from the male section 40 of the safety power connector 10, all of which are included here within. Likewise, there are many ways anticipated to energize a mechanical switch of the female section 20 of the safety power connector 10 by way of a protrusion emanating from the male section 40 of the safety power connector 10, all of which are included here within.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A safety power connector comprising:

a male section having two or more contacts, a permanent magnet, and a protrusion; and a female section having two or more mating contacts arranged to mate with the two or more contacts of the male section when the protrusion of the male section is within a receptacle of the female section, the female section having a first normally open switch that is closed when the protrusion is within the receptacle and a magnetically operated switch that is closed when the permanent magnet of the male section is in range of the magnetically operated switch, the normally open switch and the magnetically operated switch are arranged in electrical series between a source of electric potential and one contact of the two or more contacts;

whereby the source of electric potential is disconnected from the one of the two or more contacts until the male section is mated with the female section.

2. The safety power connector of claim 1, wherein the magnetically operated switch is a reed switch.

3. The safety power connector of claim 1, wherein the two or more contacts comprise a hot contact and a neutral contact; and the normally open switch and the magnetically operated switch are arranged in electrical series between the source of electric potential and the hot contact.

4. The safety power connector of claim 1, wherein the two or more contacts comprise a hot contact, a neutral contact, and a ground contact; and the normally open switch and the magnetically operated switch are arranged in electrical series between the source of electric potential and the hot contact.

5. The safety power connector of claim 1, further comprising additional magnetic materials in the male section that attract corresponding magnetic materials in the female section to hold and align the male section to the female section.

6. The safety power connector of claim 1, wherein the two or more contacts are concentric, planar, circular contacts.

7. The safety power connector of claim 1, the female section further comprising:

a second normally open switch that is closed when the protrusion is within the receptacle and a second magnetically operated switch that is closed when the permanent magnet of the male section is in range of the second magnetically operated switch, the normally open switch and the magnetically operated switch are arranged in electrical series between the source of electric potential and a second contact of the two or more contacts;

whereby the source of electric potential is disconnected from the one contact and the second contact of the two or more contacts until the male section is mated with the female section.

8. The safety power connector of claim 7, wherein the two or more contacts comprise a hot contact, a neutral contact, and a ground contact; the normally open switch and the magnetically operated switch are arranged in electrical series between the source of electric potential and the hot contact, and the second normally open switch and the second magnetically operated switch are arranged in electrical series between the source of electric potential and the neutral contact.

9. A safety power connector comprising:

a male section having two or more contacts, a permanent magnet, and a protrusion; and a female section having two or more mating contacts arranged to mate with the two or more contacts of the male section when the protrusion of the male section is within a receptacle of the female section, the female section having a first normally open switch that is closed when the protrusion is within the receptacle and a magnetically operated switch that is closed when the permanent magnet of the male section is in range of the magnetically operated switch, the normally open switch and the magnetically operated switch are arranged in electrical series between a source of electric potential and a hot contact of the two or more contacts;

whereby the source of electric potential is disconnected from the hot contact of the two or more contacts until the male section is mated with the female section.

10. The safety power connector of claim 9, wherein the magnetically operated switch is a reed switch.

11. The safety power connector of claim 9, wherein one of the two or more contacts comprise a neutral contact.

12. The safety power connector of claim 9, wherein the two or more contacts comprise the hot contact, a neutral contact, and a ground contact.

13. The safety power connector of claim 9, further comprising additional magnetic materials in the male section that attract corresponding magnetic materials in the female section to hold and align the male section to the female section.

14. The safety power connector of claim 9, further comprising a magnetic shield for preventing activation of adjacent female sections.

15. The safety power connector of claim 9, wherein the two or more contacts are concentric, planar, circular contacts.

16. A method of improving safety to a power outlet, the method comprising:

providing a source of power comprising of a hot power and a neutral power;

connecting the neutral power to a neutral contact of a safety power outlet;

connecting the hot power to a first side of a first normally open switch;

connecting a second side of the first normally open switch to a first side of a second normally open switch;

connecting a second side of the second normally open switch to a hot contact of the safety power outlet;

requiring a protrusion from a male connector to close one of the first normally open switch or the second normally open switch; and requiring a magnetic field from the male connector to close the other of the first normally open switch or the second normally open switch;

whereas the hot power is provided to the hot contact of the safety power outlet only after the protrusion from the male connector closes one of the first normally open switch or the second normally open switch and the magnetic field from the male connector closes the other of the first normally open switch or the second normally open switch.

17. The method of claim 16, wherein the other of the first normally open switch or the second normally open switch is a reed switch.

18. The method of claim 16, further comprising:

the source of power further comprising a ground potential;

connecting the ground potential to a ground contact of the safety power outlet.

19. The method of claim 16, further comprising holding and aligning a male section to the power outlet by attraction of a plurality of magnetic materials in the male section and in the power outlet.

20. The method of claim 16, further comprising magnetically shielding for preventing activation of adjacent power outlets.

* * * * *